US009533776B2

(12) United States Patent
Konnerth

(10) Patent No.: US 9,533,776 B2
(45) Date of Patent: Jan. 3, 2017

(54) METHOD AND DEVICE FOR FILLING PACKETS WITH PADDING IN THE FORM OF BULK MATERIAL

(75) Inventor: Hans Konnerth, Leutenbach (DE)

(73) Assignees: B & W Solutions GmbH, Bietigheim-Bissingen (DE); Koteam Maschinenbua GmbH, Remshalden (DE)

( * ) Notice: Subject to any disclaimer, the term of this patent is extended or adjusted under 35 U.S.C. 154(b) by 512 days.

(21) Appl. No.: 13/824,489

(22) PCT Filed: Sep. 16, 2011

(86) PCT No.: PCT/EP2011/066127

§ 371 (c)(1),
(2), (4) Date: Jul. 3, 2013

(87) PCT Pub. No.: WO2012/035146

PCT Pub. Date: Mar. 22, 2012

(65) Prior Publication Data

US 2013/0291998 A1 Nov. 7, 2013

(30) Foreign Application Priority Data

Sep. 17, 2010 (DE) ..... 10 2010 037 625

(51) Int. Cl.

| | |
|---|---|
| ***B65B 1/36*** | (2006.01) |
| ***B65D 81/09*** | (2006.01) |
| ***B65B 55/20*** | (2006.01) |
| *B65B 1/22* | (2006.01) |

(52) U.S. Cl.

CPC ..... *B65B 1/36* (2013.01); *B65B 55/20* (2013.01); *B65D 81/09* (2013.01); *B65B 1/22* (2013.01); *Y10T 428/2975* (2015.01)

(58) Field of Classification Search

CPC ..... B65B 1/22; B65B 1/36; B65B 55/20; B65B 57/00; B65D 81/09

USPC ..... 141/1, 2, 94; 53/52, 55, 115, 472, 474; 428/398

See application file for complete search history.

(56) References Cited

U.S. PATENT DOCUMENTS 3,805,483 A * 4/1974 Romagnoli ..... B65B 29/04 53/134.2
3,986,918 A * 10/1976 Berner ..... B29C 44/206 156/203
4,396,335 A * 8/1983 Brandstetter ..... B65B 5/101 414/789.8

(Continued)

FOREIGN PATENT DOCUMENTS

DE 603 06 407 T2 7/2007
EP 1 556 278 B1 7/2005

(Continued)

*Primary Examiner* — Timothy L Maust
*Assistant Examiner* — Andrew Schmid
(74) *Attorney, Agent, or Firm* — Pauley Erickson & Kottis

(57) ABSTRACT

A method and device for filling packages with a bulk cushioning material, in particular foam peanuts, where the cushioning material is conveyed to the package by a feed unit. In order to be able to easily fill the packages in an automated fashion, according to this invention, a measuring device is used to determine a volume of the package to be filled, a variable quantity of cushioning material is poured into a receiving container of the feed unit by a quantity-varying unit, and the poured quantity is poured into a package.

20 Claims, 4 Drawing Sheets

(56) References Cited

U.S. PATENT DOCUMENTS

| | | | | | |
|---|---|---|---|---|---|
| 5,188,880 | A * | 2/1993 | Tether | B31D 5/006 | 206/584 |
| 5,826,725 | A * | 10/1998 | Hornstein et al. | 206/584 | |
| 5,871,429 | A * | 2/1999 | Harding et al. | 493/25 | |
| 5,906,280 | A * | 5/1999 | Weder | 206/584 | |
| 7,337,595 | B2 | 3/2008 | Harding | | |
| 2002/0070241 | A1* | 6/2002 | Wehrmann | 222/281 | |
| 2004/0028852 | A1* | 2/2004 | Weder et al. | 428/35.2 | |
| 2005/0050848 | A1* | 3/2005 | Harding | 53/58 | |
| 2006/0108256 | A1* | 5/2006 | Bussey, III | B65B 55/20 | 206/522 |
| 2008/0141625 | A1* | 6/2008 | Bilkie | 53/396 | |
| 2008/0230562 | A1* | 9/2008 | Price | B65B 1/36 | 222/372 |
| 2009/0064638 | A1* | 3/2009 | Corbett | B65B 55/20 | 53/472 |
| 2013/0291998 | A1* | 11/2013 | Konnerth | 141/1 | |
| 2014/0157729 | A1* | 6/2014 | Weinmann et al. | 53/471 | |

FOREIGN PATENT DOCUMENTS

| | | | | | |
|---|---|---|---|---|---|
| EP | 1 786 682 | B1 | 5/2007 | | |
| EP | 2 204 325 | A1 | 7/2010 | | |
| EP | 2246261 | A1 * | 11/2010 | B65B 61/24 | |
| WO | WO 2004/041653 | A1 | 5/2004 | | |
| WO | WO 2004041653 | A1 * | 5/2004 | B65B 61/22 | |
| WO | WO 2006/017602 | A1 | 2/2006 | | |
| WO | WO 2006017602 | A1 * | 2/2006 | B65B 55/20 | |
| WO | WO 2006/050354 | A2 | 5/2006 | | |
| WO | WO 2006050354 | A2 * | 5/2006 | B65B 55/20 | |
| WO | WO 2008/146111 | A1 | 12/2008 | | |
| WO | WO 2008146111 | A1 * | 12/2008 | B31D 5/00 | |

* cited by examiner

METHOD AND DEVICE FOR FILLING PACKETS WITH PADDING IN THE FORM OF BULK MATERIAL

BACKGROUND OF THE INVENTION

Field of the Invention

This invention relates to a method and device for filling packages with a bulk cushioning material, particularly foam peanuts, where the cushioning material is conveyed to the package by a feed unit. This invention also relates to a device that can be used to execute the method of this invention.

Discussion of Related Art

Particularly at mail-order companies, packages are usually individually filled according to customer orders at a fully automated high bay warehouse. The articles ordered by the customer are placed into the package. Different package sizes are used depending on the number of articles to be placed in them. In order to prevent the articles inside from being damaged during postal transport, the remainder of the package is then filled with bulk cushioning material. Particularly, foam peanuts are used. These foam peanuts are composed of a biodegradable material and are poured into the package. The excess quantity is swept off so that the top surface is level with the top of the package. The package is then closed, labeled, and shipped. The swept-off cushioning elements are collected and prepared for filling subsequent packages. This manually executed packaging process is time-consuming and involves a significant amount of effort for collecting the excess foam peanuts.

Also, this known method requires the cardboard flaps forming the cover to be folded outward. In this position, however, they cannot be grasped by an automated cover closer, thus requiring further effort.

SUMMARY OF THE INVENTION

One object of this invention is to provide an effective method for filling packages with cushioning material without bending the flaps of the box outward in order to sweep off the excess quantity of peanuts.

Another object of this invention is to provide a device for filling packages that can be used to individually fill packages with cushioning material in a time-optimized fashion.

The above and other objects of this invention relating to the method are attained with a measuring device used to determine a volume of the package to be filled, wherein a variable dispensable quantity of cushioning material is poured into a receiving container of the feed unit by a quantity-varying unit, and this poured quantity is then poured into a package.

The measuring device measures the interior of the package. This measurement takes into account an occupied volume that results from the filling with the individual articles. The result determined by the measuring device is sent to the quantity-varying unit that then prepares the volume of cushioning material individually required for the respective package. The feed unit then pours the cushioning material into the receiving container. This cushioning material is then poured into the package and the filling process is complete. If a larger volume than the maximum volume of the dispensing container is required, it can be filled multiple times.

This method can be used in a fully automated fashion for filling packages.

According to one embodiment of this invention, the measuring device can be a line scanner that scans at least some regions of the interior of the package to be filled. The values determined by the measuring device are evaluated in a computing unit and converted into a filling instruction for the quantity-varying unit. The line scanner requires very little time to measure the package to be filled. It scans the package three-dimensionally from above, for example.

In some filling situations, the package is filled in such a way or so that individual items in the package are placed on top of one another in an offset arrangement, producing cavities that the line scanner cannot detect. The computing unit can be designed so that such filling situations can be taken into account by empirical values stored in a database in the computing unit. In principle, the computing unit determines the required filling quantity of cushioning material and sends this filling value to the quantity-varying unit.

One conceivable way to carry out the method of this invention is for the quantity-varying unit to be equipped with or have an adjusting device that changes the filling volume of the receiving container. This makes it possible to easily control the filling of the receiving container without requiring complex measuring devices in the feed unit. The measured volume is used to dynamically control the filling time and release time of the foam peanuts. It is thus possible to optimize and individually control the amount of time the package remains in the filling position.

In one embodiment of this invention, the receiving container is moved between a filling position and a release position, and the cushioning material is poured into it in the filling position and the cushioning material is poured into the package in the release position. Separating the filling position and the release position makes it possible to simply and precisely control the dispensing of cushioning material into the receiving container.

Thus, it is possible for the receiving container to have a closing part directly or indirectly coupled to it, which closes a dispensing opening of the feed unit when the receiving container is moved from the filling position to the release position and opens the dispensing opening when the receiving container is moved from the release position to the filling position.

Another time optimization for the package-filling procedure of this invention can be achieved if as the receiving container is moved from the filling position into the release position, it is moved in the transport direction of the package.

For time optimization reasons, it is also possible, in a movement of the receiving container from the release position into the filling position, to use the return path to adjust the quantity-varying unit.

In one embodiment of this invention, after the package is filled, a vibrating unit sets it into a vibrating motion. Then the cushioning material is compressed, which achieves a compact fixing of the products in the box.

The above and other objects of this invention relating to the device are attained with a filling quantity that is determined by a measuring device and that can be poured into the receiving container by the quantity-varying unit.

The measuring device can automatically determine the partial volume of the package to be filled and can transmit this to the quantity-varying unit. The quantity-varying unit can then adjust the filling quantity.

Thus, it is possible for the receiving container to have an adjusting device by which it is possible to change the filling volume of the receiving container.

It is possible in this embodiment for the adjusting device to adjust the bottom of the receiving container which makes it possible to quickly achieve a volume adjustment with a small amount of control effort.

A quick release of the cushioning material into the package is successfully achieved if the bottom of the receiving container has at least one shutter element that spatially connects the container interior to the package in the release position.

The cushioning material, particularly foam peanuts, has a low specific weight and thus it is necessary to provide an optimized air flow path so that the cushioning elements fall into the package in the fastest possible time. In order to prevent a vacuum from building up in the receiving container that would impede a release of the cushioning elements, in one embodiment of this invention, the receiving container is delimited by side walls provided with a perforation. The perforation opens an air flow path which ensures that the cushioning elements are able to fall out freely.

It is advantageous if the foam peanut is of a recyclable foam material, for example a cornstarch which is cylindrical, and has a diameter ≥10 mm, and preferably a diameter in the range between 13 mm and 19 mm, and has an axial length in the range between 10 mm and 50 mm, preferably in the range between 20 mm and 40 mm. The foam peanuts are easy to dispense and do not have a tendency to jam in the mechanism of the receiving container.

When there are large differences between box heights, the falling position of the foam peanuts is preset by a vertically adjustable bellows, which can be adjusted between the package and the release opening of the receiving container.

BRIEF DESCRIPTION OF THE DRAWINGS

This invention is explained in greater detail below in view of an exemplary embodiment shown in the drawings, wherein.

DETAILED DESCRIPTION OF INVENTION

Figure 1:
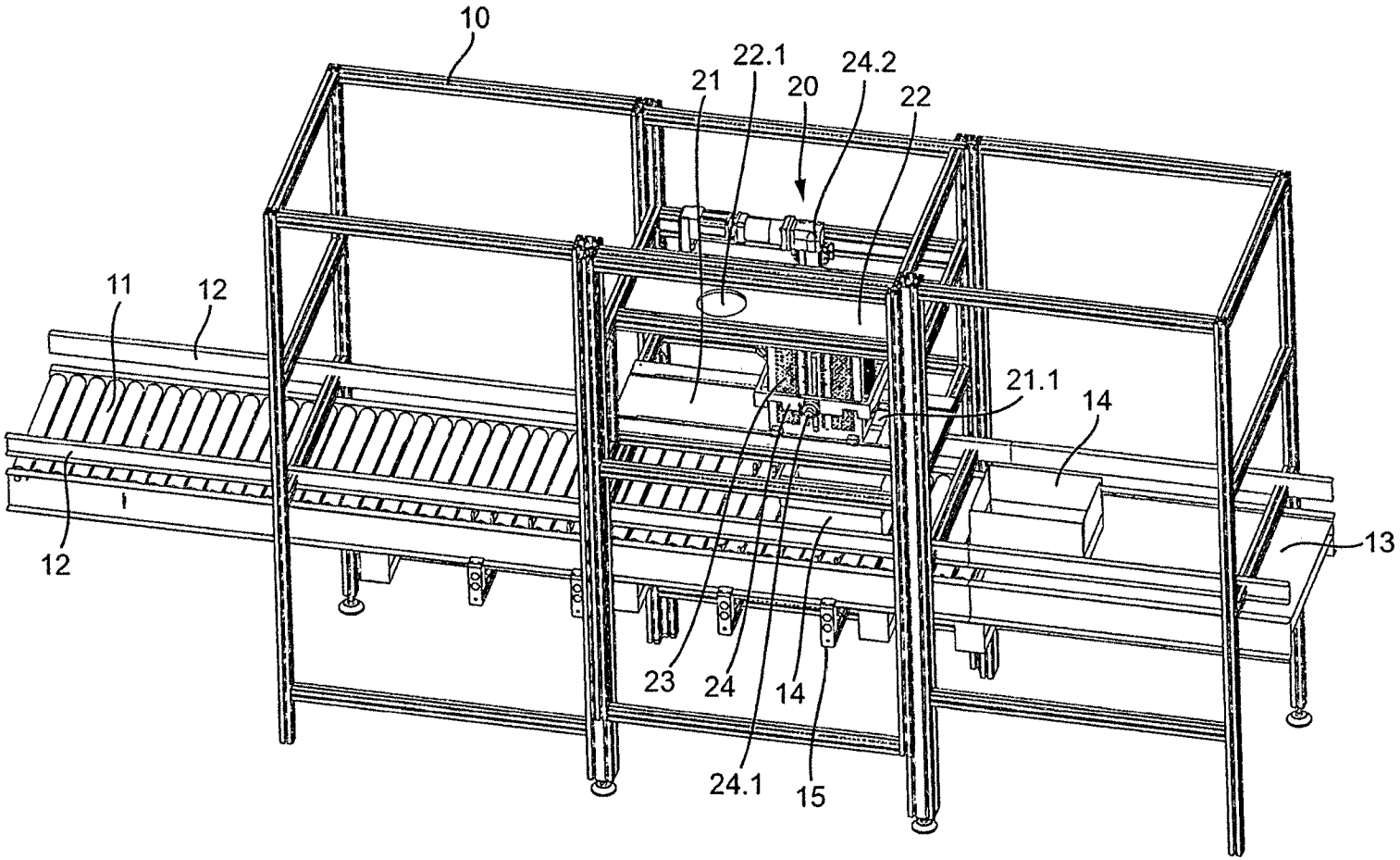
FIG. 1 is a perspective side view of a device for filling packages with a cushioning material.

FIG. 1 shows a device for filling packages with a cushioning material, in particular foam peanuts. This device has a base frame 10 that is composed of or of frame profiles. The base frame 10 has a built-in feed unit 11. The feed unit 11 includes a multitude of transport rollers via which packages 14 can be guided. The feed unit 11 is laterally delimited by two guide rails 12 in order to prevent packages 14 from falling off of the feed unit 11.

Figure 4:
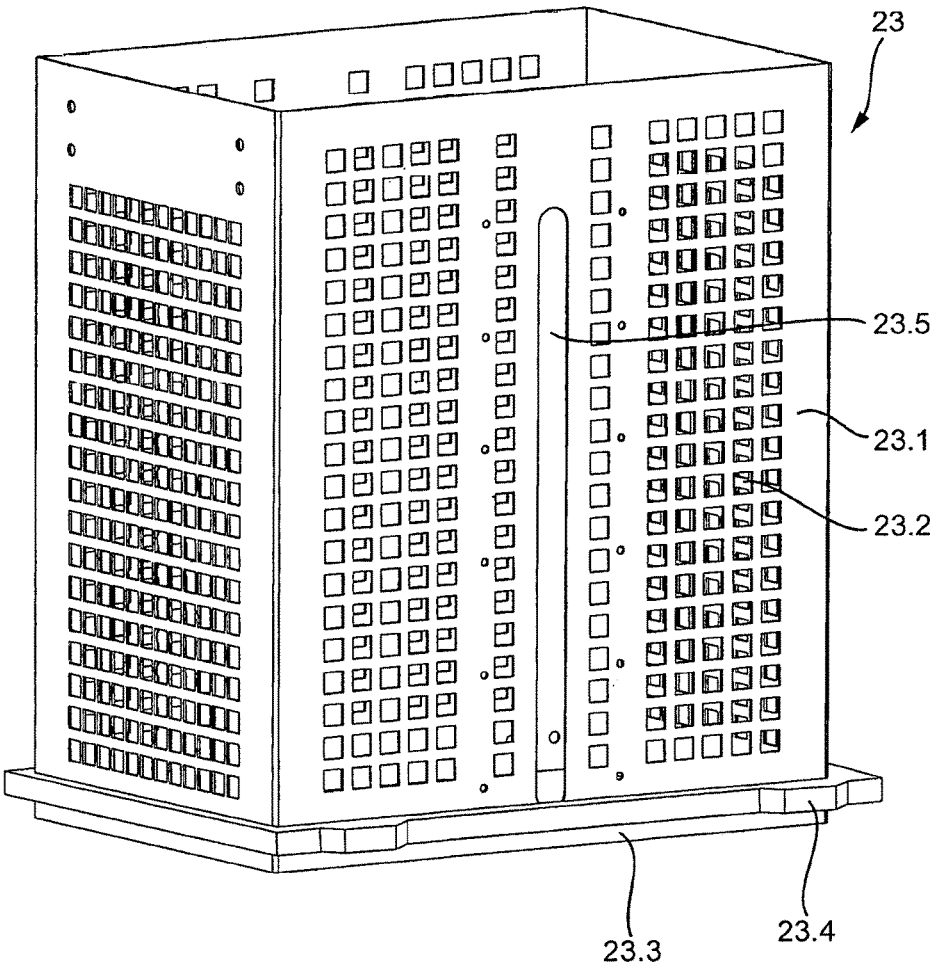
FIG. 4 is a perspective side view of a receiving container.

The base frame 10 also has a built-in filling unit 20. The filling unit 20 includes a receiving container 23 that is shown in greater detail in FIG. 4 which shows the receiving container 23 delimited by four vertical side walls 23.1. The side walls 23.1 are provided with or have a perforation 23.2. The perforations 23.2 are embodied in the form of openings that produce an air-conveying connection between the receiving container interior and the surroundings.

The front and rear side walls 23.1 have a slot 23.5 that extends in the vertical direction. At the bottom, the side walls 23.1 are attached to a support frame 23.3. The support frame 23.3 has guide lugs 23.4. As shown in FIG. 1, the receiving container 23 is coupled to an adjusting unit 24.2.

Figure 2:
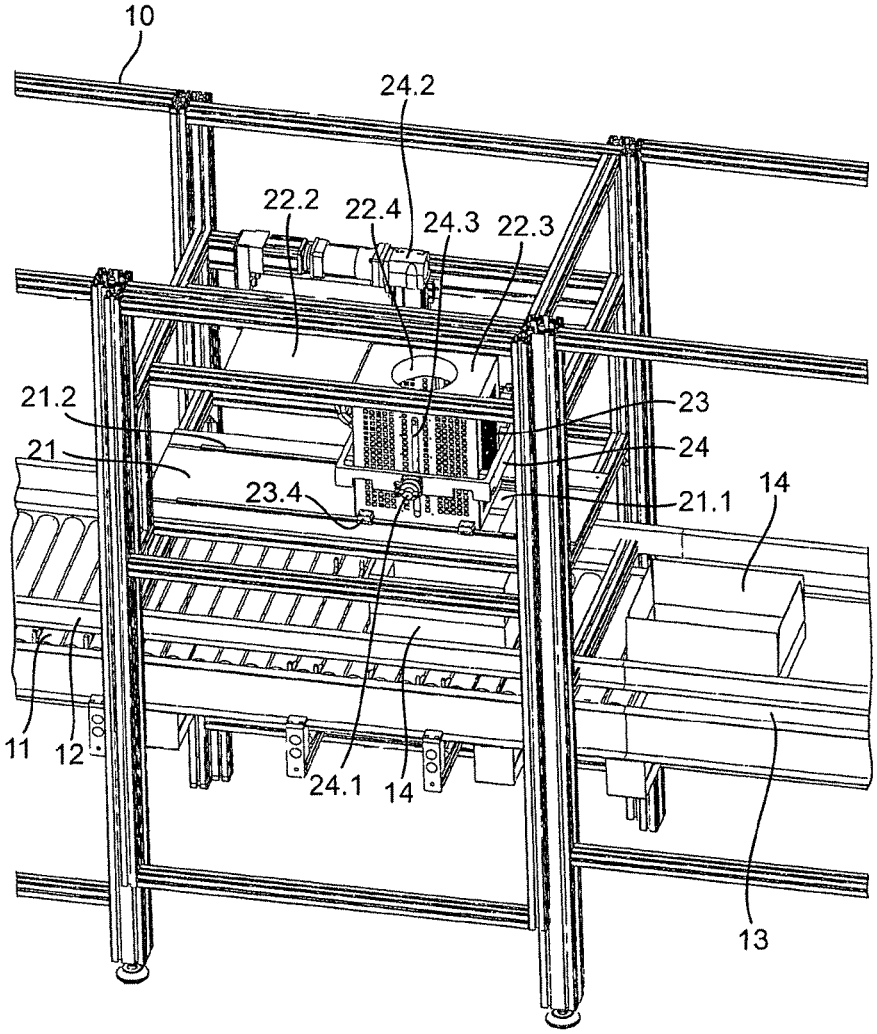
FIG. 2 shows an enlarged detail from FIG. 1.
Figure 3:
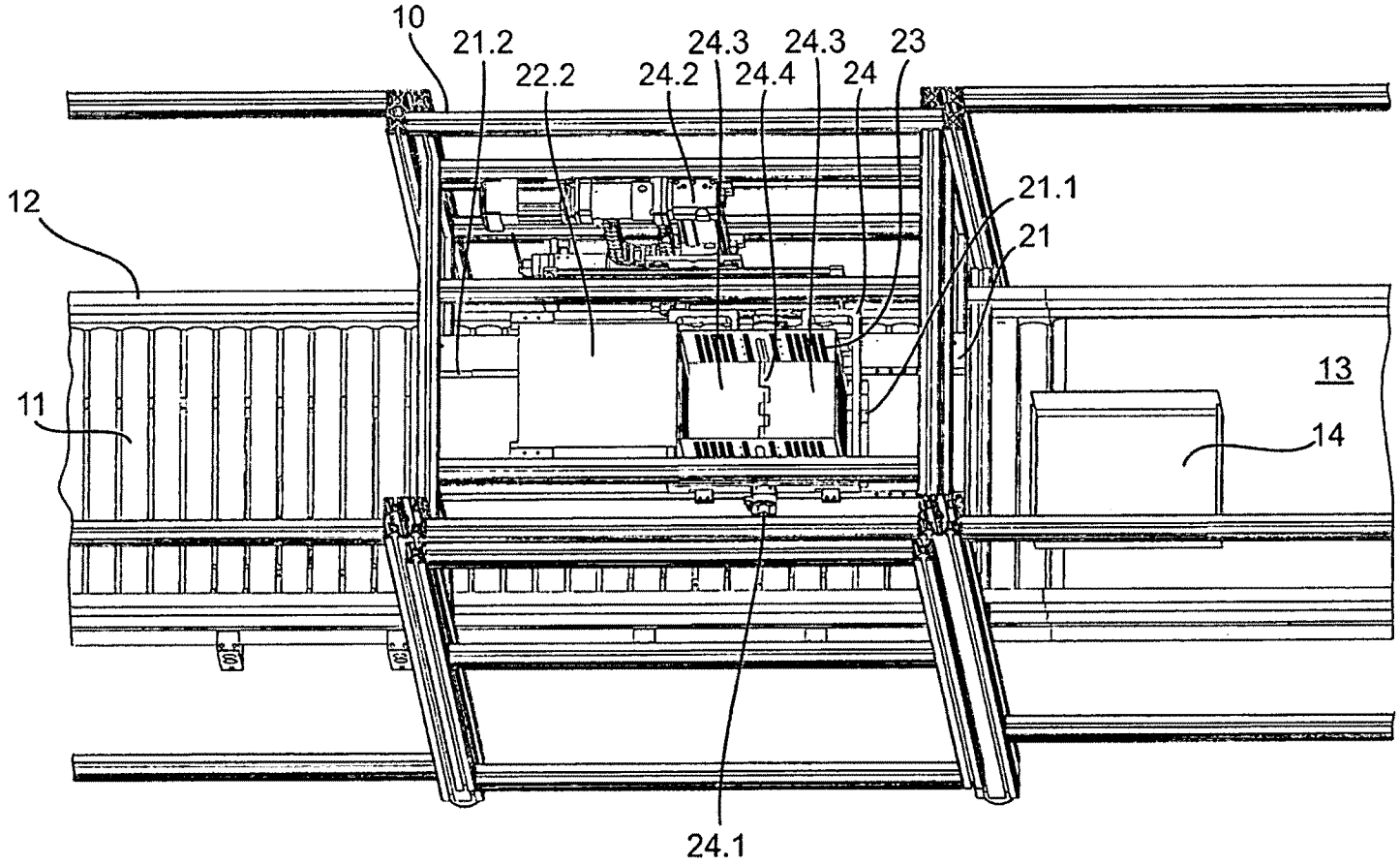
FIG. 3 is a top view of the depiction according to FIG. 2.

As shown in FIGS. 2 and 3, the adjusting unit 24.2 includes a quantity-varying unit 24. This quantity-varying unit 24 has a support frame that includes the receiving container 23. The support frame has an axle 24.1 coupled to it, which extends through both slots 23.5 of the receiving container 23. The axle 24.1 has shutter elements 24.3 in the form of flaps coupled to it.

FIG. 3 shows such flap embodied as a shutter element 24.3 that extends from the axle 24.1 on each of its two sides. The shutter elements 24.3 are supported so that they can pivot around the axle 24.1 and can be swung downward out of the closed position shown in FIG. 3, in which they form the bottom of the receiving container 23. This downward swinging motion is carried out by an electric motor or is produced in a pneumatically controlled way. Correspondingly, in the swung downward position, the shutter elements 24.3 can open the bottom of the receiving container 23, producing a release opening. The electric motor or a pneumatic drive can move the shutter elements 24.3 back into the starting position shown in FIG. 3 individually or together, in a synchronous fashion.

The support frame of the quantity-varying unit 24 is coupled to the adjusting unit 24.2. The adjusting unit 24.2 can adjust the support frame and with it, the two shutter elements 24.3, in the vertical direction. It is thus possible to vary the height of the bottom of the receiving container 23. The available filling volume of the receiving container 23 can thus be changed with infinite variability. The adjusting unit 24.2 thus constitutes or forms a linear guide in the vertical direction. In addition, the adjusting unit 24.2 also has a horizontal guide. With this horizontal guide, the receiving container 23 can be moved in linear fashion between a filling position and a release position. For this purpose, the guide lugs 23.4 of the receiving container 23 have sliders connected to them, which can slide in the guides 21.2 of a guide plate 21. The guide plate 21 has an opening 21.1 that is shown in FIG. 2. FIG. 2 shows the receiving container 23 just before it arrives at the release position. The receiving container 23 is in its release position when it covers the opening 21.1. Starting from the release position, the adjusting unit 24.2 can move the receiving container 23 toward the left until it is in the filling position. In the filling position, the receiving container 23 is situated or positioned below a filling opening 22.1 of a plate-shaped stripper 22.

The stripper 22 is shown in FIG. 1. The filling opening 22.1 is coupled to a supply line, such as a tube of a feed unit. As shown in FIG. 2, the receiving container 23 has a closing part 22.2 in the form of a plate coupled to it. The cover side of the receiving container 23 is closed with a cover part 22.3 that has an opening 22.4. In the filling position, the opening 22.4 coincides with the filling opening 22.1.

The function of the device shown in the drawings is described below.

Packages 14 are supplied to the filling unit 20 via the feed unit 11. Before reaching the filling unit 20, the packages 14 are conveyed past or beyond a measuring device. The measuring device, which is not shown in the drawings, has a line scanner that takes measurements by scanning into the open package 14 from above. This generates a three-dimensional scan image of the package interior and thus determines the volume in the package 14 that is to be filled with cushioning material. This is calculated based on the total available package volume minus the volume occupied by products. In some cases, the products with which the package is filled may be placed into the package in a partially overlapping way, producing undercuts that the line scanner cannot detect. The filling volume can be determined with an external computing unit to which the results of the line scanner are conveyed and by accounting for empirical values stored in a database. If necessary, the filling volume can be varied by correction factors in order to adapt to the cushioning material used.

This setpoint value is sent to the quantity-varying unit 24. Correspondingly, the quantity-varying unit 24 sets the adjusting height of the shutter elements 24.3 so that a volume in the receiving container 23 is produced, which corresponds to the package volume to be filled. This adjusting procedure preferably occurs as the receiving container 23 is moved from the release position back into the filling position. In the filling position, the opening 22.4 is aligned with the filling opening 22.1. Then, the foam peanuts can fall into the receiving container 23. When the filling procedure is complete, the receiving container moves from its filling position into the release position. As a result, the closing part 22.2 is moved over the filling opening 22.1 so that the latter is closed and no more foam peanuts can fall out of the feed unit. If the receiving container 23 reaches its release position, then the two shutter elements 24.3 are swung downward and the foam peanuts can fall through the dispensing opening 21.1 into the package 14 to be filled. Then the shutter elements 24.3 are moved back to their initial position so that they once again form the closed the bottom of the receiving container 23. The package 14 is then released and is transported into the vicinity of or near an output unit 13. This area can have a removing unit for NIO-measured packages integrated into it.

The next package 14 to be filled is then positioned under the dispensing opening 21.1 again. The next package 14 has already been measured ahead of time in the measuring device and the volume to be filled has been determined. The support frame of the quantity-varying unit 24 then moves into the required position, which determines the filling volume for the package 14 in a time-optimized fashion during the movement of the receiving container 23 into the filling position. The above-described sequence can then be carried out again.

A vibrating unit 15 is coupled to the feed unit 11. During the filling or at the end of the filling procedure, this vibrating unit 15 vibrates the package 14, causing the foam peanuts to flow into all of the cavities. The vibrating unit 15 is also associated with a centering device which centers the package 14 under the release opening of the receiving container 23. As shown in FIG. 1, the feed unit 11 is also equipped with or has a stopping device, by which the package 14 to be filled is stopped under the receiving container 23.

The invention claimed is:

1. A method for filling packages with a bulk cushioning material, comprising:

providing the cushioning material to a feed unit including a receiving container (23) and a quantity-varying unit (24) having an adjusting device that automatically changes the filling volume of the receiving container (23);

automatically determining a volume of the package (14) to be filled;

automatically moving the adjusting device with respect to the receiving container (23) to change the filling volume of the receiving chamber (23) as a function of the determined volume of the package;

the quantity-varying unit (24) automatically pouring a variable quantity of cushioning material corresponding to the determined volume into the receiving container (23); and pouring the variable quantity within the receiving container (23) into the package.

2. The method according to claim 1, wherein a measuring device automatically determines a volume of the package (14) to be filled, the measuring device is a line scanner that scans at least a portion of regions of an interior of the package (14) to be filled, and values determined by the measuring device are evaluated in a computing unit and converted into a filling instruction including the determined volume for the quantity-varying unit (24).

3. The method according to claim 2, wherein the receiving container (23) is moved between a filling position and a release position, and the cushioning material is poured into it in the filling position and the cushioning material is poured into the package (14) in the release position.

4. The method according to claim 3, wherein the receiving container (23) has a closing part (22.2) directly or indirectly coupled which closes a dispensing opening (21.1) of the feed unit when the receiving container (23) is moved from the filling position to the release position and opens it when the receiving container (23) is moved from the release position to the filling position.

5. The method according to claim 4, wherein the quantity-varying unit (24) is adjusted during a movement of the receiving container (23) from the release position into the filling position.

6. The method according to claim 5, wherein after being filled the package (14) is set into a vibrating motion by a vibrating unit.

7. The method according to claim 1, further comprising:

automatically determining a further volume of a further package to be filled, wherein the further volume is different than the volume of the package (14);

the adjusting device changing the filling volume of the receiving container (23) to correspond to the further volume;

the quantity-varying unit (24) automatically pouring a further variable quantity of cushioning material corresponding to the determined further volume into the receiving container (23); and pouring the further variable quantity of the receiving container (23) into the further package.

8. The method according to claim 1, wherein the cushioning material comprises a foam peanut, wherein the foam peanut is of a recyclable foam material including cornstarch, is cylindrical, and has a diameter ≥10 mm and an axial length in a range between 10 mm and 50 mm.

9. The method according to claim 1, wherein the quantity-varying unit (24) comprises a support frame that adjusts in a vertical direction to vary a height of a bottom of the receiving container (23).

10. The method according to claim 9 wherein the bottom of the receiving container (23) has at least one shutter element (24.3) pivotally connected to the receiving container (23) by an axle, and further comprising pivoting the shutter element (24.3) downward about the axle to open the receiving container (23) and spatially connect the receiving container (23) interior to the package (14) when in a downward release position.

11. The method according to claim 10, wherein the axle extends through and is vertically moveable within slots in sides of the receiving container (23).

12. The method according to claim 9, wherein the support frame extends around the receiving container (23).

13. The method according to claim 12 wherein the support frame includes an axle supporting a openable shutter element forming a bottom of the receiving container (23), and the axle extends through opposing slots within sides of the receiving container (23).

14. A device for filling packages with a bulk cushioning material, and including a receiving container (23) associated with a quantity-varying unit (24), wherein the quantity-varying unit (24) adjusts a filling quantity determined by a measuring device adapted to determine an interior volume of the package (14) to be filled, and feeds the adjusted filling quantity into the receiving container (23), wherein the bottom of the receiving container (23) has at least one shutter element (24.3) pivotally connected to the receiving container (23) by an axle, and the shutter element (24.3) is adapted to pivot downward about the axle to open the receiving container (23) and spatially connect the receiving container (23) interior to the package (14) when in a downward release position.

15. The device according to claim 14, wherein the receiving container (23) has an adjusting device that changes the filling volume of the receiving container (23).

16. The device according to claim 15, wherein the adjusting device vertically adjusts a bottom of the receiving container (23).

17. The device according to claim 16, wherein the receiving container (23) is delimited by side walls (23.1) provided with a perforation (23.2) and each of two opposing side walls includes a slot through which the axle extends and vertically moves.

18. The device according to claim 17, wherein a shape of a closing part (22.2) prevents a jamming of a dispensing container during the movement from a filling station into the release station, with the closing part (22.2) positioned under a stripper (22) and spaced apart from a filling opening (22.1).

19. The device according to claim 18, wherein a centering device centers the packages (24) under the release position.

20. The device according to claim 19, wherein the cushioning material comprises foam peanuts and the filling time and the release time of the foam peanuts are dynamically controlled as a function of the determined volume.

* * * * *